US008532273B2

(12) United States Patent
Park et al.

(10) Patent No.: US 8,532,273 B2
(45) Date of Patent: Sep. 10, 2013

(54) HOME APPLIANCE AND HOME APPLIANCE SYSTEM

(75) Inventors: Hyung Jun Park, Changwon-si (KR); Hae Yong Kang, Changwon-si (KR); Young Soo Kim, Changwon-si (KR); Si Moon Jeon, Changwon-si (KR); Koon Seok Lee, Changwon-si (KR); Yong Tae Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 650 days.

(21) Appl. No.: 12/431,910

(22) Filed: Apr. 29, 2009

(65) Prior Publication Data

US 2010/0026507 A1 Feb. 4, 2010

Related U.S. Application Data

(60) Provisional application No. 61/048,794, filed on Apr. 29, 2008.

(51) Int. Cl.
*H04M 11/00* (2006.01)

(52) U.S. Cl.
USPC ..... 379/106.01; 379/106.07; 379/106.11; 379/102.01; 379/102.07; 340/679

(58) Field of Classification Search
USPC ..... 379/106.01, 106.07, 106.11, 102.01, 379/102.07, 102.04, 93.37, 37, 90.01, 9.04, 379/92.01, 92.03, 92.04; 340/53, 679, 310.06, 340/310.08
See application file for complete search history.

(56) References Cited

U.S. PATENT DOCUMENTS

| | | | |
|---|---|---|---|
| 3,910,322 | A | 10/1975 | Hardesty et al. |
| 4,766,505 | A | 8/1988 | Nakano et al. |
| 4,897,659 | A | 1/1990 | Mellon |
| 4,977,394 | A | 12/1990 | Manson et al. |
| 5,103,214 | A | 4/1992 | Curran et al. |
| 5,210,784 | A | 5/1993 | Wang et al. |
| 5,268,666 | A | 12/1993 | Michel et al. |
| 5,452,344 | A | 9/1995 | Larson |

(Continued)

FOREIGN PATENT DOCUMENTS

| | | |
|---|---|---|
| CN | 1212304 | 3/1999 |
| EP | 0 038 687 | 10/1981 |

(Continued)

OTHER PUBLICATIONS

International Search Report dated Dec. 1, 2010 (PCT/KR2010/002211).

(Continued)

*Primary Examiner* — Vivian Chin
*Assistant Examiner* — Leshui Zhang
(74) *Attorney, Agent, or Firm* — KED & Assocaiates LLP

(57) ABSTRACT

A home appliance and a home appliance system are provided. The home appliance may convert product information into an acoustic signal and externally output the same as a sound. The home appliance system may receive the sound, convert the same into the acoustic signal, and then inversely convert the acoustic signal into the product information and read the same. Accordingly, the home appliance may externally output the acoustic signal as the sound so that the user may be easily notified of transmission. Also, the home appliance system may easily transmit the sound to a management device to read the product information because the sound may be transmitted via a communications network.

21 Claims, 6 Drawing Sheets

(56) References Cited

U.S. PATENT DOCUMENTS

| | | | | |
|---|---|---|---|---|
| 5,506,892 | A * | 4/1996 | Kojima et al. | 379/102.03 |
| 5,757,643 | A | 5/1998 | Kuroda et al. | |
| 5,774,529 | A * | 6/1998 | Johannsen et al. | 379/106.03 |
| 5,864,828 | A | 1/1999 | Atkins | |
| 5,940,915 | A | 8/1999 | Nam | 8/159 |
| 5,987,105 | A * | 11/1999 | Jenkins et al. | 379/106.01 |
| 6,121,593 | A | 9/2000 | Mansbery et al. | |
| 6,759,954 | B1 | 7/2004 | Myron et al. | |
| 6,763,458 | B1 | 7/2004 | Watanabe et al. | 713/100 |
| 6,778,868 | B2 | 8/2004 | Imamura et al. | |
| 6,870,480 | B2 | 3/2005 | Suzuki et al. | |
| 6,906,617 | B1 | 6/2005 | Van der Meulen | |
| 7,135,982 | B2 | 11/2006 | Lee | 340/635 |
| 7,266,164 | B2 | 9/2007 | Jeon et al. | |
| 7,280,643 | B2 | 10/2007 | Howard et al. | 379/93.37 |
| 7,337,457 | B2 | 2/2008 | Pack et al. | 725/40 |
| 7,439,439 | B2 | 10/2008 | Hayes et al. | 84/600 |
| 7,509,824 | B2 | 3/2009 | Park et al. | 68/12.23 |
| 7,648,476 | B2 | 1/2010 | Bock et al. | |
| 7,653,512 | B2 | 1/2010 | Cheung et al. | 702/184 |
| 7,843,819 | B1 | 11/2010 | Benveniste | |
| 7,965,632 | B2 | 6/2011 | Sugaya | |
| 8,027,752 | B2 | 9/2011 | Castaldo et al. | |
| 8,040,234 | B2 | 10/2011 | Ebrom et al. | 340/531 |
| 8,045,636 | B1 | 10/2011 | Lee et al. | |
| 8,132,049 | B2 | 3/2012 | Yasukawa et al. | |
| 8,204,189 | B2 | 6/2012 | Rhodes et al. | |
| 8,391,255 | B2 | 3/2013 | Ribiere et al. | |
| 2002/0029575 | A1 | 3/2002 | Okamoto | |
| 2002/0032491 | A1 | 3/2002 | Imamura et al. | |
| 2002/0078742 | A1 | 6/2002 | Kim | 73/162 |
| 2002/0097161 | A1 | 7/2002 | Deeds | |
| 2002/0116959 | A1 | 8/2002 | Ohta et al. | |
| 2002/0120728 | A1 | 8/2002 | Braatz et al. | |
| 2003/0028345 | A1 | 2/2003 | Watkins et al. | |
| 2003/0128850 | A1 | 7/2003 | Kimura et al. | |
| 2003/0196492 | A1 | 10/2003 | Remboski et al. | 73/593 |
| 2004/0032853 | A1 | 2/2004 | D'Amico et al. | |
| 2004/0132444 | A1 | 7/2004 | Herrmann | |
| 2004/0158333 | A1 | 8/2004 | Ha et al. | |
| 2004/0211228 | A1 | 10/2004 | Nishio et al. | |
| 2004/0249903 | A1 | 12/2004 | Ha et al. | |
| 2004/0261468 | A1 | 12/2004 | Lueckenbach | |
| 2005/0015890 | A1 | 1/2005 | Kim et al. | |
| 2005/0029976 | A1 | 2/2005 | Terry et al. | |
| 2005/0086979 | A1 | 4/2005 | Son et al. | |
| 2005/0129200 | A1 | 6/2005 | Forrest et al. | 379/93.37 |
| 2005/0134472 | A1 | 6/2005 | Jang et al. | |
| 2005/0162909 | A1 | 7/2005 | Wooldridge | |
| 2006/0048405 | A1 | 3/2006 | Baek et al. | |
| 2006/0066758 | A1 | 3/2006 | Higashihara | |
| 2006/0089818 | A1 | 4/2006 | Norell et al. | |
| 2006/0136544 | A1 | 6/2006 | Atsmon et al. | |
| 2006/0168740 | A1 | 8/2006 | Ha et al. | |
| 2006/0259199 | A1 | 11/2006 | Gjerde et al. | |
| 2007/0113595 | A1 | 5/2007 | Harwood et al. | |
| 2007/0137265 | A1 | 6/2007 | Shikamori et al. | |
| 2007/0175883 | A1 | 8/2007 | Miu et al. | |
| 2007/0189323 | A1 | 8/2007 | Swoboda et al. | |
| 2007/0219756 | A1 | 9/2007 | Frankel et al. | |
| 2007/0272286 | A1 | 11/2007 | Curtius et al. | |
| 2008/0036619 | A1 | 2/2008 | Rhodes et al. | |
| 2008/0072383 | A1 | 3/2008 | Bextermoller et al. | |
| 2008/0122648 | A1 | 5/2008 | Ebrom et al. | |
| 2009/0067102 | A1 | 3/2009 | Cline et al. | |
| 2009/0160637 | A1 | 6/2009 | Maeng | |
| 2009/0169434 | A1 | 7/2009 | Ogusu | |
| 2009/0282308 | A1 | 11/2009 | Gutsche et al. | |
| 2009/0323914 | A1 | 12/2009 | Lee et al. | |
| 2010/0037401 | A1 | 2/2010 | Bae et al. | |
| 2010/0116060 | A1 | 5/2010 | Murayama | 73/593 |
| 2011/0022358 | A1 | 1/2011 | Han et al. | |
| 2011/0060553 | A1 | 3/2011 | Han et al. | |
| 2011/0200189 | A1 | 8/2011 | True et al. | |

FOREIGN PATENT DOCUMENTS

| | | | |
|---|---|---|---|
| EP | 0510519 | | 10/1992 |
| EP | 0 617 557 | A2 | 9/1994 |
| EP | 0 742 308 | | 11/1996 |
| EP | 0 846 991 | | 6/1998 |
| EP | 0 851 054 | | 7/1998 |
| EP | 0691060 | | 5/2004 |
| JP | 4-358497 | | 12/1992 |
| JP | 11-127254 | | 11/1999 |
| JP | 2001-345949 | | 12/2001 |
| JP | 2001-353395 | | 12/2001 |
| JP | 2002-000988 | | 1/2002 |
| JP | 2002-011274 | | 1/2002 |
| JP | 2002-045590 | A | 2/2002 |
| JP | 2002-85887 | | 3/2002 |
| JP | 2002-162149 | | 6/2002 |
| JP | 2002-279091 | | 9/2002 |
| JP | 2007-267956 | | 10/2007 |
| JP | 2008-003562 | | 1/2008 |
| KR | 10-1991-0020404 | A | 12/1991 |
| KR | 10-1996-0003308 | A | 1/1996 |
| KR | 10-1997-0019443 | A | 4/1997 |
| KR | 10-0127232 | | 10/1997 |
| KR | 10-0127232 | B1 | 10/1997 |
| KR | 10-0143209 | | 8/1998 |
| KR | 20-1999-0040564 | U | 12/1999 |
| KR | 20-0162050 | | 12/1999 |
| KR | 10-2000-0018678 | | 4/2000 |
| KR | 10-2001-0063913 | A | 5/2001 |
| KR | 10-2001-0055394 | A | 7/2001 |
| KR | 10-2002-0020831 | A | 3/2002 |
| KR | 10-2002-0030426 | A | 4/2002 |
| KR | 10-2002-0039959 | | 5/2002 |
| KR | 10-0389690 | B1 | 6/2003 |
| KR | 10-0406094 | B1 | 11/2003 |
| KR | 10-2004-0050767 | | 6/2004 |
| KR | 10-2004-0095017 | | 11/2004 |
| KR | 10-2005-0062747 | A | 6/2005 |
| KR | 10-2005-0097282 | A | 10/2005 |
| KR | 10-0564761 | B1 | 3/2006 |
| KR | 10-2006-0103014 | | 9/2006 |
| KR | 10-0641974 | | 11/2006 |
| KR | 10-2007-0013090 | | 1/2007 |
| KR | 10-2008-0068447 | | 7/2008 |
| KR | 10-0887575 | | 3/2009 |
| KR | 10-2010-0112950 | | 10/2010 |
| KR | 10-2011-0010378 | | 2/2011 |
| WO | WO 01/11575 | | 2/2001 |
| WO | WO 2005/106096 | | 11/2005 |
| WO | WO 2008/010670 | | 1/2008 |

OTHER PUBLICATIONS

International Search Report dated Dec. 1, 2010 (PCT/KR2010/002222).

PCT International Search Report dated May 26, 2011 issued in Application No. PCT/KR2010/005108.

International Search Report dated Aug. 23, 2010 (Application No. PCT/KR2010/000319).

Creber, R. K. et al.; "Performance of Undersea Acoustic Networking Using RTS/CTS Handshaking and ARQ Retransmission"; Oceans, 2001 MTS/IEEE Conference and Exhibition; Nov. 5-8, 2001; Piscataway, NJ; IEEE, vol. 4; Nov. 5, 2001; pp. 2083-2086 (XP010566758).

European Search Report dated Oct. 14, 2011 issued in Application No. 09 73 8950.

International Search Report dated Dec. 18, 2009.

International Search Report dated Dec. 21, 2009.

International Search Report dated Jan. 4, 2010.

International Search Report dated Apr. 25, 2011 issued in Application No. PCT/KR 2010/004407.

United States Office Action dated Dec. 27, 2011 issued in U.S. Appl. No. 12/432,184.

United States Office Action dated Feb. 10, 2012 issued in U.S. Appl. No. 12/568,022.

United States Office Action dated Mar. 1, 2012 issued in U.S. Appl. No. 12/846,040.

Russian Office Action dated Feb. 7, 2012. (with translation).
U.S. Office Action issued in U.S. Appl. No. 12/431,903 dated Mar. 8, 2012.
U.S. Office Action issued in U.S. Appl. No. 12/431,893 dated Mar. 19, 2012.
U.S. Office Action issued in U.S. Appl. No. 12/432,132 dated Mar. 20, 2012.
U.S. Office Action issued in U.S. Appl. No. 12/757,205 dated Apr. 2, 2012.
Russian Office Action issued in Application No. 2010144513/08 dated Jun. 27, 2012.
International Search Report issued in Application No. PCT/KR2011/000311 dated Jul. 28, 2011.
U.S. Office Action issued in U.S. Appl. No. 12/431,893 dated Jul. 31, 2012.
Notice of Allowance issued in U.S. Appl. No. 12/842,679 dated Aug. 1, 2012.
U.S. Office Action issued in U.S. Appl. No. 12/431,903 dated Aug. 2, 2012.
U.S. Office Action issued in U.S. Appl. No. 12/432,184 dated Aug. 7, 2012.
Korean Office Action dated Aug. 13, 2012.
U.S. Office Action issued in U.S. Appl. No. 12/432,132 dated Aug. 15, 2012.
U.S. Office Action issued in U.S. Appl. No. 12/551,827 dated Aug. 16, 2012.
Notice of Allowance issued in U.S. Appl. No. 12/846,040 dated Aug. 17, 2012.
Japanese Office Action dated Sep. 11, 2012.
Notice of Allowance issued in U.S. Appl. No. 12/757,205 dated Sep. 14, 2012.
U.S. Office Action issued in U.S. Appl. No. 12/847,303 dated Sep. 14, 2012.
U.S. Office Action issued in U.S. Appl. No. 12/757,232 dated Sep. 18, 2012.
U.S. Office Action issued in U.S. Appl. No. 12/432,111 dated May 2, 2012.
European Search Report dated May 8, 2012.
Milica Stojanovic; "Recent Advances in High-Speed underwater Acoustic Communications"; IEEE Journal of Oceanice Engineering, IEEE Service Center; Piscataway, NJ; vol. 21, No. 2; Apr. 1, 1996; pp. 125-136 (XP011042321).
U.S. Office Action issued in U.S. Appl. No. 12/757,246 dated May 18, 2012.
U.S. Office Action issued in U.S. Appl. No. 12/757,339 dated May 22, 2012.
U.S. Notice of Allowance issued in U.S. Appl. No. 12/568,022 dated Jun. 11, 2012.
U.S. Office Action issued in U.S. Appl. No. 12/757,213 dated Jun. 25, 2012.
U.S. Office Action issued in U.S. Appl. No. 12/603,810 dated Jul. 5, 2012.
European Search Report dated Dec. 17, 2012.
European Search Report dated Jan. 2, 2013.
Ethem M Sözer; "Simulation and Rapid Prototyping Environment for Underwater Acoustic Communications: Reconfigurable Modem"; OCEANS—Europe 2005; MIT Sea Grant College Program; Cambridge, MA, 02139; IEEE; pp. 80-85 (XP10838461A).
U.S. Office Action issued in U.S. Appl. No. 12/757,339 dated Jan. 31, 2013.
European Search Report dated Jan. 31, 2013. (10761908.2).
European Search Report dated Jan. 31, 2013. (10797292.9).
Japanese Office Action dated Feb. 12, 2013. (with translation).
U.S. Office Action issued in U.S. Appl. No. 12/603,810 dated Feb. 13, 2013.
U.S. Office Action issued in U.S. Appl. No. 12/551,827 dated Mar. 11, 2013.
U.S. Office Action issued in U.S. Appl. No. 12/842,649 dated Mar. 22, 2013.
U.S. Office Action issued in U.S. Appl. No. 12/432,111 dated Nov. 15, 2012.
Chinese Office Action dated Nov. 16, 2012.
U.S. Office Action issued in U.S. Appl. No. 12/757,213 dated Dec. 13, 2012.
U.S. Office Action issued in U.S. Appl. No. 12/432,132 dated Dec. 19, 2012.
U.S. Office Action issued in U.S. Appl. No. 12/850,240 dated Dec. 27, 2012.
U.S. Office Action issued in U.S. Appl. No. 12/846,013 dated Dec. 28, 2012.
U.S. Notice of Allowance issued in U.S. Appl. No. 12/847,303 dated Jan. 11, 2013.
U.S. Office Action issued in U.S. Appl. No. 12/431,903 dated Jan. 2, 2013.
U.S. Office Action issued in U.S. Appl. No. 12/757,246 dated Jan. 17, 2013.
U.S. Office Action issued in U.S. Appl. No. 12/431,893 dated Jan. 29, 2013.
U.S. Office Action issued in U.S. Appl. No. 12/847,406 dated Jul. 9, 2013.
U.S. Office Action issued in U.S. Appl. No. 12/847,306 dated Jul. 9, 2013.
U.S. Appl. No. 12/431,893, filed Apr. 29, 2009.
U.S. Appl. No. 12/431,903, filed Apr. 29, 2009.
U.S. Appl. No. 12/432,111, filed Apr. 29, 2009.
U.S. Appl. No. 12/432,132, filed Apr. 29, 2009.
U.S. Appl. No. 12/551,827, filed Sep. 1, 2009.
U.S. Appl. No. 12/757,339, filed Apr. 9, 2010.
U.S. Appl. No. 12/568,022, filed Sep. 28, 2009.
U.S. Appl. No. 12/757,205, filed Apr. 9, 2010.
U.S. Appl. No. 12/757,213, filed Apr. 9, 2010.
U.S. Appl. No. 12/757,232, filed Apr. 9, 2010.
U.S. Appl. No. 12/757,246, filed Apr. 9, 2010.
U.S. Appl. No. 12/603,810, filed Oct. 22, 2009.
U.S. Appl. No. 12/432,184, filed Apr. 29, 2009.
U.S. Appl. No. 13/382,334, filed Jan. 5, 2012.
U.S. Appl. No. 13/808,414, filed Jan. 4, 2013.
U.S. Appl. No. 13/808,403, filed Jan. 4, 2013.
U.S. Appl. No. 12/842,649, filed Jul. 23, 2010.
U.S. Appl. No. 12/842,679, filed Jul. 23, 2010.
U.S. Appl. No. 12/846,013, filed Jul. 29, 2010.
U.S. Appl. No. 12/846,040, filed Jul. 29, 2010.
U.S. Appl. No. 12/847,272, filed Jul. 30, 2010.
U.S. Appl. No. 12/847,303, filed Jul. 30, 2010.
U.S. Appl. No. 12/847,406, filed Jul. 30, 2010.
U.S. Appl. No. 12/847,284, filed Jul. 30, 2010.
U.S. Appl. No. 12/847,306, filed Jul. 30, 2010.
U.S. Appl. No. 12/850,240, filed Aug. 4, 2010.
U.S. Appl. No. 13/522,066, filed Jul. 13, 2012.
U.S. Appl. No. 13/562,704, filed Jul. 31, 2012.
U.S. Appl. No. 13/588,164, filed Aug. 17, 2012.
U.S. Notice of Allowance issued in U.S. Appl. No. 12/603,810 dated Jun. 12, 2013.
U.S. Office Action issued in U.S. Appl. No. 12/432,111 dated Jun. 13, 2013.
U.S. Office Action issued in U.S. Appl. No. 12/847,272 dated Jun. 27, 2013.
U.S. Office Action issued in U.S. Appl. No. 12/757,213 dated Jun. 28, 2013.
U.S. Office Action issued in U.S. Appl. No. 12/847,284 dated Jun. 28, 2013.

* cited by examiner

HOME APPLIANCE AND HOME APPLIANCE SYSTEM

This application claims priority to U.S. Provisional Application No. 61/048,794, filed Apr. 29, 2008, which is hereby incorporated by reference.

BACKGROUND

1. Field

A home appliance and a home appliance system including the home appliance are disclosed herein.

2. Background

Home appliances are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Conventionally, when problems with a home appliance occur, a user usually calls a service center to ask for a repairman. However, the repairmen's visits to the user's home incurs excessive costs and it is often not easy to deal with problems when doing repairs because no prior information is provided. With the development of technology, a technique of remotely diagnosing fault information using a telephone network has been developed.

European Patent No. 0510519 discloses a technique of sending fault information of a home appliance to a service center using a telephone network via a modem connected to the home appliance. With this technique, the modem must be connected to the home appliance. However, a home appliance, such as a laundry treatment machine, may be installed outdoors, and thus, there are location restrictions that must be considered to connect the laundry treatment machine and the telephone network.

U.S. Pat. No. 5,987,105 discloses a technique of converting fault information of a home appliance into a sound of an audible frequency band using a telephone network and sending the same to a service center via a telephone. However, with this technique, signal interference may occur depending on a surrounding environment in the procedure of converting the fault information of the home appliance into a sound of an audible frequency and then sending the same to a telephone handset, and data loss may occur depending on characteristics of a telephone network in the procedure of sending the sound via the telephone network. Moreover, conventional home appliances have the problem that, since they do not inform users of the point of time when the fault information is output, they cannot correctly transmit the fault information.

Moreover, there is a problem that, in the event of damage to product information obtained by reading the sound, it is impossible for a conventional home appliance system to receive an external command signal and retransmit the product information, thereby being unable to deliver correct product information.

Embodiments disclosed herein relate to a home appliance and a home appliance system. Embodiments of a home appliance and home appliance system will be described using a laundry treatment machine and a laundry treatment machine system as examples. However, embodiments are not limited to a laundry treatment machine and laundry treatment machine system, but rather, are applicable to other home appliances. Such home appliances may include, for example, a TV, an air conditioner, a washing machine, a refrigerator, an electric rice cooker, or a microwave or conventional oven.

Figure 1:
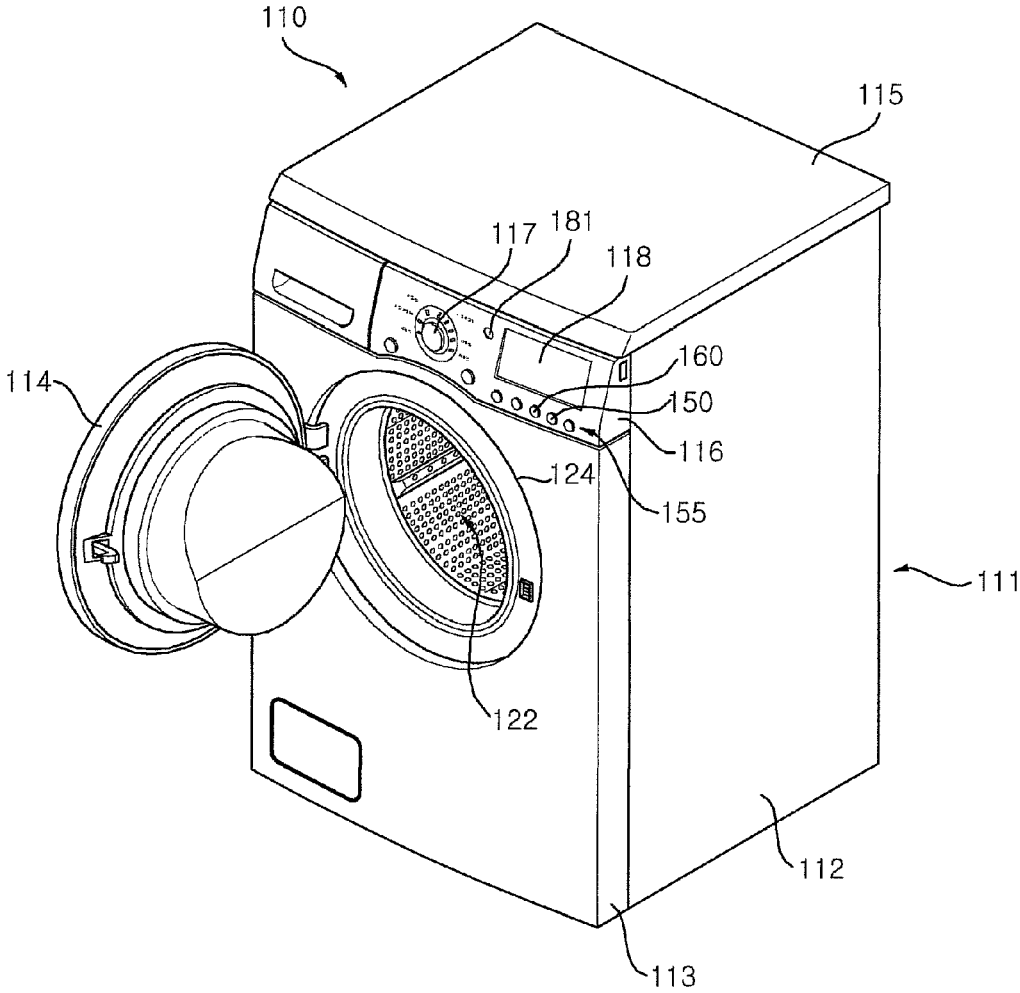
FIG. 1 is a front perspective view of a home appliance in the form of a laundry treatment machine according to an embodiment.
Figure 2:
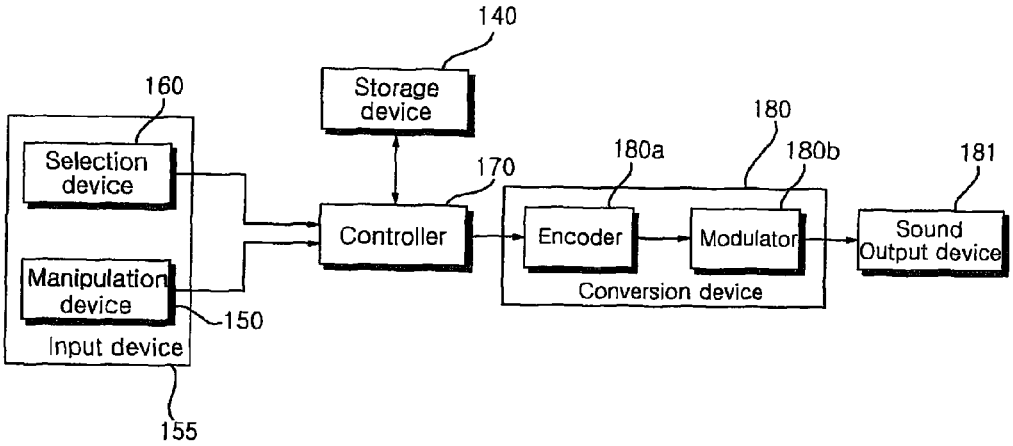
FIG. 2 is a block diagram showing a control flow of the laundry treatment machine of FIG. 1 according to an embodiment.

FIG. 1 is a front perspective view of a laundry treatment machine 110 according to an embodiment. Referring to FIG. 1, the laundry treatment machine 110 may include a cabinet 111, a tub 122 disposed inside the cabinet 111 that performs washing of laundry, a motor (not shown) that drives the tub 122, a washing fluid supply device (not shown) that supplies washing fluid to the tub 122, and a drainage device (not shown) that discharges washing fluid outside of the laundry treatment machine 110 after the washing is completed. The cabinet 111 may include a cabinet body 112, a cabinet cover 113 coupled to the cabinet body 112, a control panel 116, including a dial 117 and display 118, disposed over the cabinet cover 113 that controls operation of the laundry treatment machine 110, and a top plate 115. The cabinet cover 113 may include a hole 124 through which laundry may be put into/removed from the tub 122 and a door 114 that rotates to open and close the hole 124. FIG. 2 is a block diagram showing a control flow of the laundry treatment machine 110 of FIG. 1. Referring to FIG. 2, the laundry treatment machine 110 may include an input device 155 including a manipulation device 150 and a selection device 160 that receives input of an external command signal for executing fault diagnosis from the user, a conversion device 180 that converts product information into at least one acoustic signal, a sound output device 181 that outputs a signal sound corresponding to the acoustic signal output from the conversion device 180 to the outside when the external command signal is input from the selection device 160, and a controller 170 that includes a storage device 140 that stores the product information of the home appliance for the fault diagnosis, loads the product information stored in the storage device 140 and transmits the same to the conversion device 180 when the fault diagnosis is selected through the selection device 160, and controls a unit conversion time during which the conversion device 180 outputs the product information as the acoustic signal when the acoustic signal is output to the sound output device 181. The laundry treatment machine 110 may further include a storage device 140 that stores the product information. The storage device 140 may be formed integrally with the control device 170 or separately from the control device 170.

The conversion device 180 may include an encoder 180*a* and a modulator 180*b*. The encoder 180*a* may encode each bit of the product information into symbols. The modulator 180*b* may modulate the symbols to an analog signal. The modulated signal, e.g. the at least one acoustic signal may then be output to the sound output device 181. The sound output device 181 may receive the modulated signal, e.g. the at least one acoustic signal, and output the same as a sound.

The modulator 180*b* may modulate the symbols using, for example, any one of a frequency shift keying method, an amplitude shift keying method, or a phase shift keying method. The frequency shift keying method is a modulation method that modulates a data value of the product information onto a signal of a predetermined frequency. The amplitude shift keying method is a modulation method that varies a level of amplitude in response to a data value. The phase shift keying method is a modulation method that varies a phase according to a data value of the product information.

When the laundry treatment machine 110 is operated, product information of the laundry treatment machine 110 may be generated. The product information may be sent to the controller 170. The product information may be made up of unit signals. Further, the product information may include at least one of operating information or fault information of the laundry treatment machine 110. The operating information may include information required for the operation of the laundry treatment machine 110, such as information about a washing stroke, a dehydration stroke, and a rinsing stroke of the laundry treatment machine 110. The fault information may be selected from fault information generated during each operation when the operation of the laundry treatment machine 110 is performed and mechanical fault information of the laundry treatment machine 110.

The controller 170 may transmit the product information to the conversion device 180. The transmitted product information may be converted into at least one acoustic signal in the conversion device 180. The sound output device 181 may receive the at least one acoustic signal and output the same as the sound corresponding to the at least one acoustic signal.

Meanwhile, the sound output device 181 may be, for example, a speaker, a buzzer, or any other means for output a sound.

Additionally, the user may input an operation control command through the manipulation device 150. When the operation control command is input, the controller 170 controls the at least one acoustic signal converted and output by the conversion device 180 so that the user may be notified of the outputting of the sound. The configuration of the at least one acoustic signal will be described below in detail.

Figure 3:
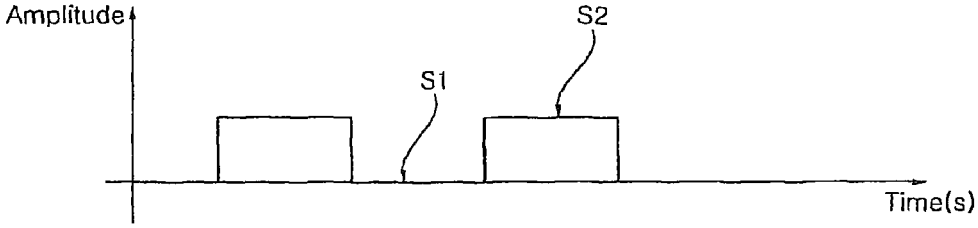
FIG. 3 is a graph showing unit signals of product information of the laundry treatment machine of FIG. 1.
Figure 4:
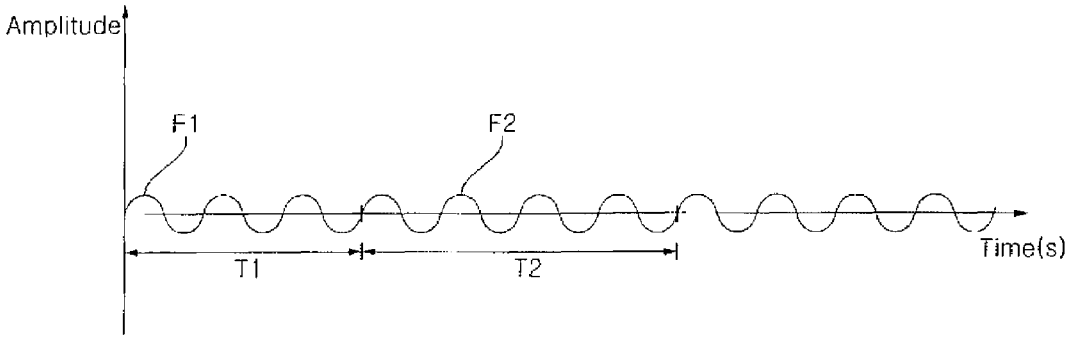
FIG. 4 is a graph of acoustic signals converted from product information according to an embodiment.

FIG. 3 is a graph showing unit signals of product information of the laundry treatment machine 110 of FIG. 1. FIG. 4 is a graph of acoustic signals converted from product information according to an embodiment. Like reference numerals have been used to indicate like elements.

Referring to FIGS. 3 and 4, the product information may comprise unit signals. The unit signals may include a first unit signal S1 and a second unit signal S2 different from the first unit signal S1. Meanwhile, the product information may be formed of a combination of the unit signals. The controller 170 may control the conversion device 180 to output an acoustic signal F1 corresponding to the first unit signal S1 during a first unit conversion time T1 and an acoustic signal F2 corresponding to the second unit signal S2 during a second unit conversion time T2 different from the first unit conversion time T1. Meanwhile, the acoustic signal F1 corresponding to the first unit time S1 and the acoustic signal F2 corresponding to the second unit signal S2 may have same frequency.

That is, when the first unit signal S1 of the product information is input into the conversion device 180, an acoustic signal F1 corresponding to the first unit signal S1 having at least one frequency may be converted and output. Also, when the second unit signal S2 of the product information is input into the conversion device 180, the controller 170 may generate an acoustic signal F2 corresponding to the second unit signal S2 having at least one frequency. Also, since the at least one frequency is the same, the controller device 170 may control the signals such that the first unit conversion time T1 during which the acoustic signal F1 corresponding to the first unit signal S1 is output and the second unit conversion time T2 during which the acoustic signal F2 corresponding to the second unit signal S2 is output are different from each other. The output sounds may be output during a time period different from each other. Therefore, the sounds output by being converted from the product information may enable the inverse conversion and collection of the product information.

Meanwhile, the controller 170 may control the unit conversion times T1 and T2 according to the operation control command input by the user via the manipulation device 150. That is, when the user inputs the operation control command through the manipulation device 150, the controller 170 may set the first unit conversion time T1 and the second unit conversion time T to be different from each other. Hence, the conversion device 180 may output the acoustic signals through the above-stated procedure.

Figure 5:
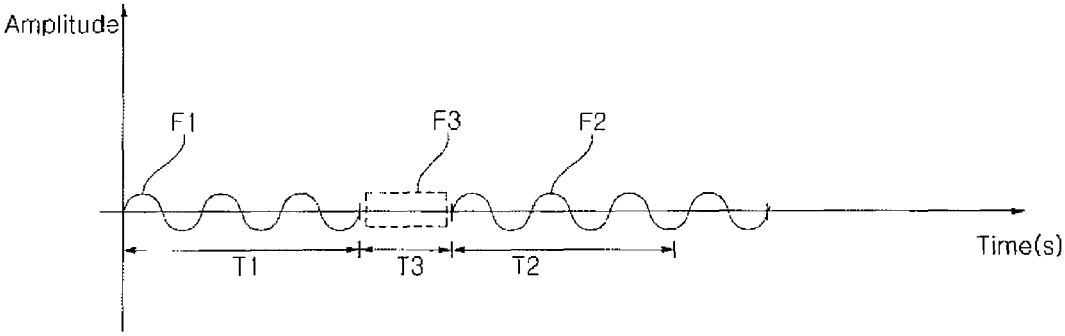
FIG. 5 is a graph of acoustic signals converted from product information according to another embodiment.

FIG. 5 is a graph of acoustic signals F1 and F2 according to another embodiment. Like reference numerals have been used to indicate like elements. The following description is focused on differences from the previous embodiment, and repetitive disclosure has been omitted.

Referring to FIG. 5, the controller 170 may control the conversion device 180 to output a separation signal F3 during a separation time T3 between the first unit conversion time T1 and the second unit conversion time T2 in order to separate the acoustic signal F1 corresponding to the first unit signal S1 and the acoustic signal F2 corresponding to the second unit signal S2. That is, when the first unit signal S1 is input into the conversion device 180, the conversion device 180 may convert the first unit signal S1 into the acoustic signal F1 corresponding to the first unit signal S1 and outputs it during the first unit conversion time T1. Upon completion of the conversion of the first unit signal S1, the conversion device 180 may output a separation signal F3 during the separation time T3. Upon completion of the outputting of the separation signal F3, the conversion device 180 may convert the second unit signal S2 into the acoustic signal F2 corresponding to the second unit signal S2 and output it during the second unit conversion time T2. The first unit conversion time T1 and the second unit conversion time T2 may be controlled in a different manner. Therefore, even if the acoustic signal F1 corresponding to the first unit signal S1 and the acoustic signal F2 corresponding to the second unit signal S have the same frequency, they may be separated by the separation signal F3. Also, since the first unit conversion time T1 and the second unit conversion time T2 may be different from each other, the acoustic signals F1 and F2 may be discriminated externally.

Meanwhile, the separation signal F3 may not have a frequency. That is, a sound corresponding to the separation signal F3 may be mute.

Figure 6:
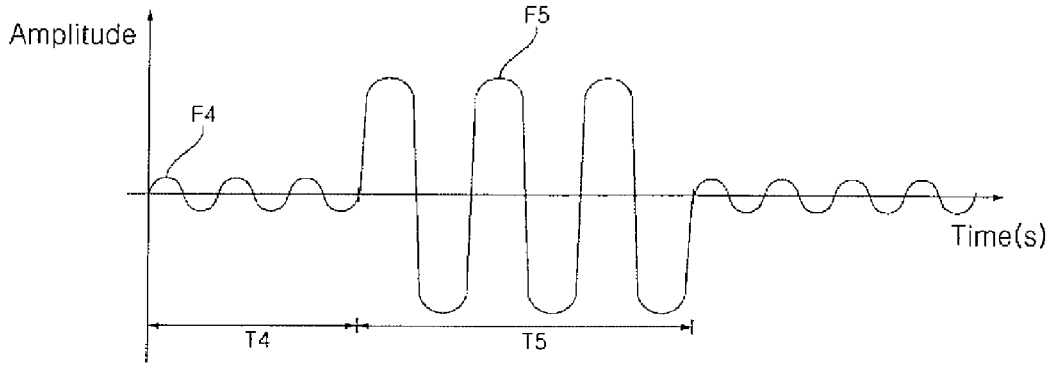
FIG. 6 is a graph of the acoustic signals converted from product information according to another embodiment.

FIG. 6 is a graph of acoustic signals F1 and F2 according to another embodiment. Like reference numerals have been used to indicate like elements. The following description is focused on differences from the previous embodiments, and repetitive disclosure has been omitted.

Referring to FIG. 6, the at least one frequency may include a plurality of frequencies. The plurality of frequencies may include a first frequency corresponding to a first unit signal S1 and a second frequency different from the first frequency and corresponding to a second unit signal S2. That is, when the first unit signal S1 is input, the controller 170 may control the conversion device 180 to convert an acoustic signal F4 corresponding to the first unit signal so as to have the first frequency. On the other hand, when the second unit signal S2 is input, the controller 170 may control the conversion device 180 to convert an acoustic signal F5 corresponding to the second unit signal and having the second frequency. Also, the controller 170 may control the acoustic signal F4 corresponding to the first unit signal and containing the first frequency to be output during a first unit conversion time T4. The controller 170 may control the acoustic signal F5 corresponding to the second unit signal and containing the second frequency to be output during a second unit conversion time T5. Also, the controller 170 may control the first unit conversion time T4 and the second unit conversion time T5 to be different from each other. Therefore, in the laundry treatment machine 110, the sounds corresponding to the acoustic signals F4 and F5 may have different frequencies from each other, and may be externally output for different time periods. That is, since the signals may be externally output for different time periods, even if it is not easy to discriminate between the first frequency and the second frequency, the sounds may be discriminated based on the unit conversion times T4 and T5. As a result, the sounds may be effectively delivered.

Figure 7:
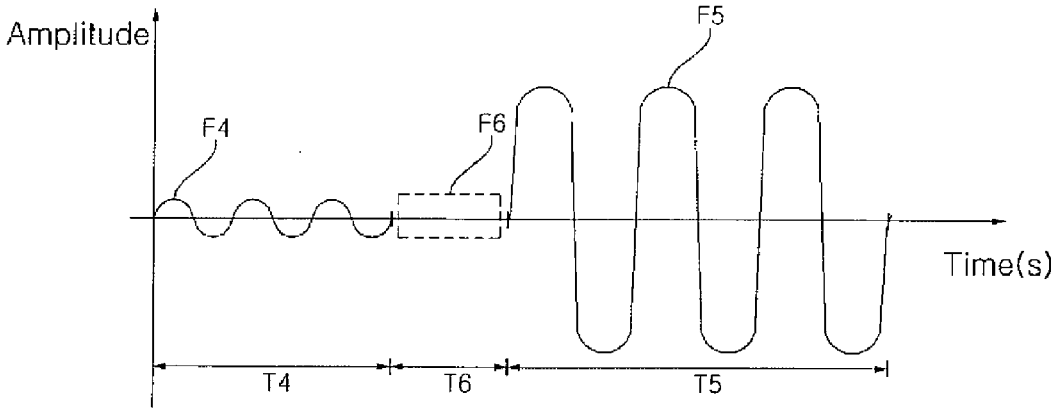
FIG. 7 is a graph of the acoustic signals converted from product information according to another embodiment.

FIG. 7 is a graph showing of acoustic signals F4 and F5 according to another embodiment. Like reference numerals have been used to indicate like elements. The following description is focused on the differences from the above-stated embodiments.

Referring to FIG. 7, the controller 170 may control the conversion device 180 to output a separation signal F6 during a separation time T6 between an acoustic signal F4 corresponding to a first unit signal S1 and an acoustic signal F5 corresponding to a second unit signal S in order to separate the acoustic signal F4 from the acoustic signal F5. That is, when a first unit signal S1 is input into the conversion device 180, the controller 170 may control the conversion device 180 to output an acoustic signal F4 having a first frequency. Upon completion of the outputting of the acoustic signal F4 having the first frequency, the controller 170 may control the conversion device 180 to output a separation signal F6 during a separation time T6. Also, upon completion of the separation signal F6, the controller 170 may control the conversion device 180 to output an acoustic signal F5 having a second frequency. Therefore, the acoustic signals F4 and F5 may be respectively output during the unit conversion times T4 and T5 different from each other, and discriminated by the separation signal F6, thus making the signals corresponding to the acoustic signals F4 and F5 efficiently discriminated from each other.

Figure 8:
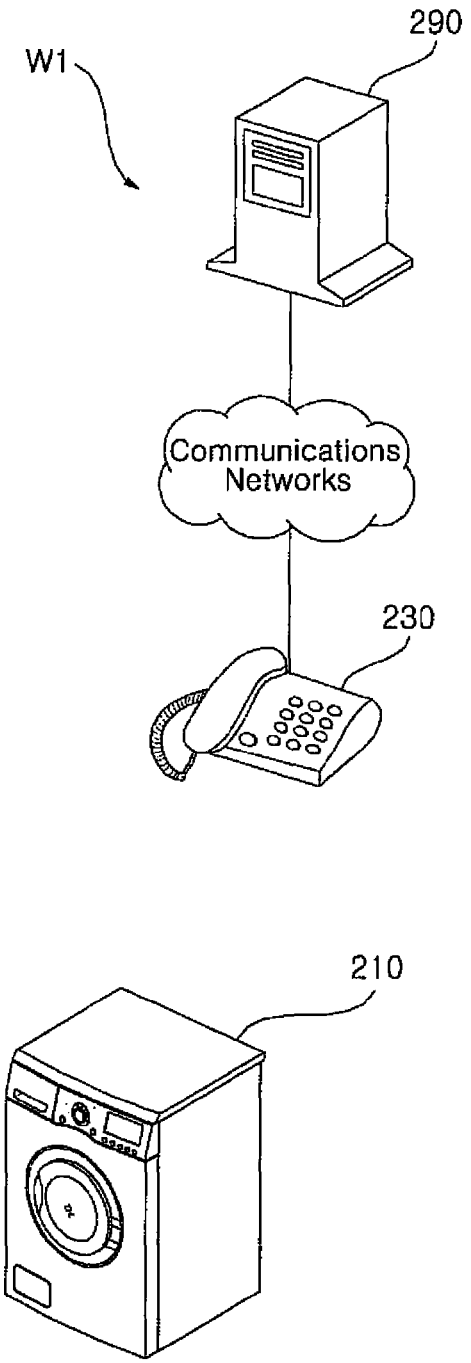
FIG. 8 is a perspective view of a home appliance system in the form of a laundry treatment machine system W1 according to an embodiment.
Figure 9:
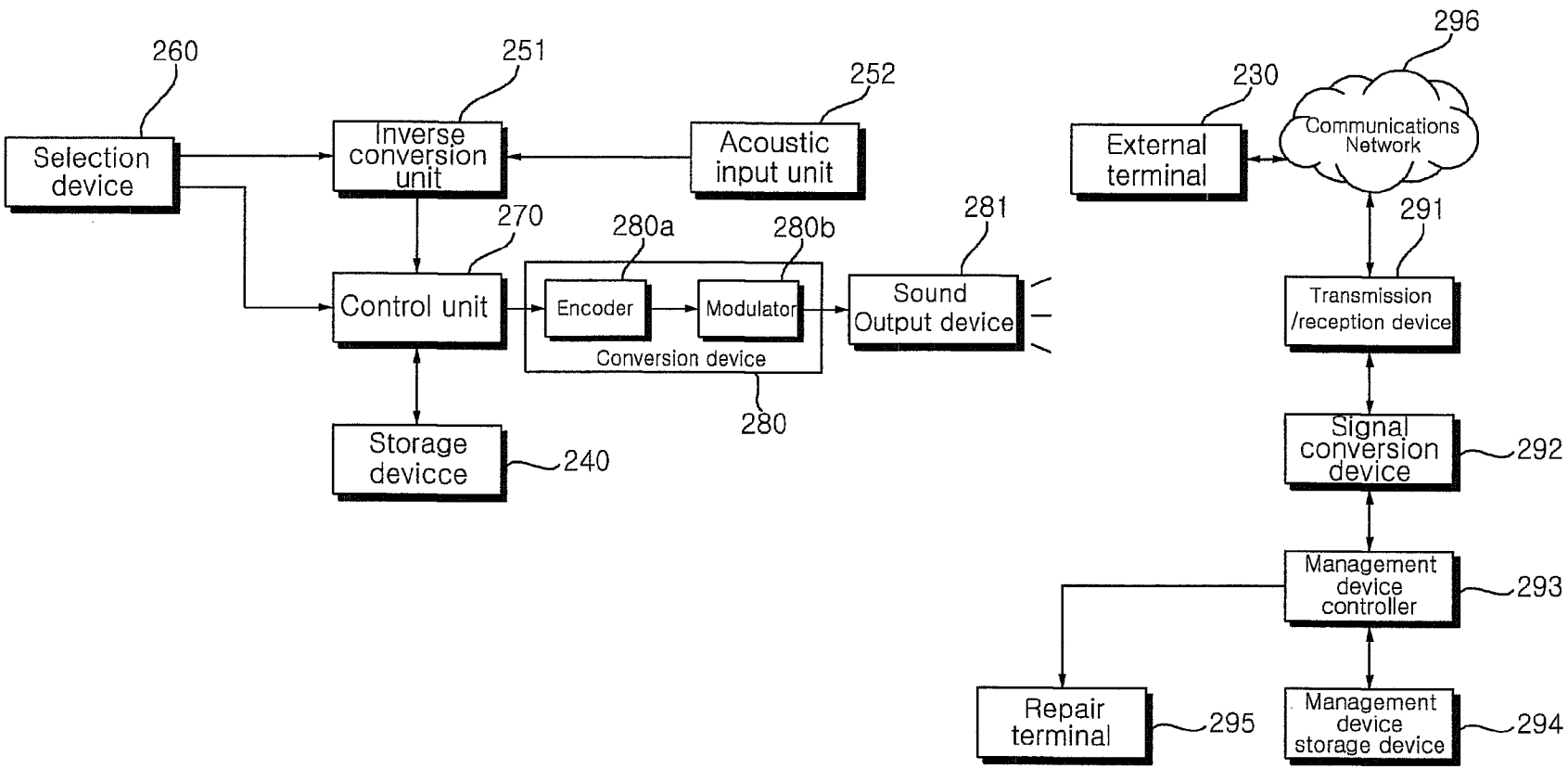
FIG. 9 is a block diagram showing a control flow of the laundry treatment machine system W1 of FIG. 8.

FIG. 8 is a perspective view of a home appliance system in the form of a laundry treatment machine system W1 according to an embodiment. FIG. 9 is a block diagram showing a control flow of the laundry treatment machine system W1 of FIG. 8. As discussed above, embodiments are not limited to the laundry treatment machine system W1, but rather, may be configured for any kind of home appliance. The laundry treatment machine system W1 according to this embodiment will be discussed hereinbelow.

Referring to FIGS. 8 and 9, the laundry treatment machine system W1 may include a laundry treatment machine 210, an input device including a manipulation device 150 and a selection device 260 that receives input of an external command signal for executing fault diagnosis from the user, a conversion device 280 that converts product information into at least one acoustic signal, a sound output device 281 that outputs a signal sound corresponding to the acoustic signal output from the conversion device 280 to the outside when the external command signal is input from the selection device 260, a controller 270 that includes a storage device 240 that stores the product information of the home appliance for the fault diagnosis, loads the product information stored in the storage device 240 and transmits the same to the conversion device 280 when the fault diagnosis is selected through the selection device 260, and controls a unit conversion time during which the conversion device 280 outputs the product information as the acoustic signal when the acoustic signal is output to the sound output device 281, and a management device 290 that receives the sound and inversely converts the sound into the product information based on the sound. The conversion device 280, the sound output device 281, and the controller 270 may be formed separately from the laundry treatment machine 210, or may be included in the laundry treatment machine 210.

The laundry treatment machine 210 may include the same or similar components as described in FIGS. 1 and 2. The management device 290 may include a transmission/reception device 291 that transmits and receives the sound output to the outside from the sound output device 281 of the laundry treatment machine 210, a signal conversion device 292 that inversely converts the sound received from the transmission/reception device 291 into the product information, a management device controller 293 that reads the converted product information, a management device storage device 294 that stores the product information read by the management device controller 293, and a repair terminal 295 that transmits the product information read by the management device controller 293 to a repairman.

A method for converting the product information of the laundry treatment machine 210 into an acoustic signal to output the same and outputting a sound corresponding to the acoustic signal and a control flow thereof are the same or similar to those as described with respect to FIG. 2. Further, a method for converting the product information into an acoustic signal is also the same or similar to those as described with respect to FIGS. 3 to 7.

The sound output from the sound output device 281 may be transmitted to the management device 290 via a communications network 296. Further, the laundry treatment machine system W1 may further include an external terminal 230 connected to the management device 290 and the communications network 296. The external terminal 230 may include any device capable of transmitting the sound output from the sound output device 281, such as a wired phone, a wireless phone, or a mobile phone, to the management device 290. The user may input the sound output from the sound output device 281 into the external terminal 230. In contrast to the description of FIG. 2, the sound input from the external terminal 230 may be converted into a voice signal, and the voice signal may be inversely converted into the product information. The inversely-converted product information may be compared with previously input data to be linked to the repairman.

That is, regarding the control flow of the management device 290, as described in FIGS. 3 to 7, when the conversion device 280 outputs the acoustic signals, the sound output device 281 may output a sound corresponding to the acoustic signals to outside of the laundry treatment machine 210. The output sound may be transmitted to the management device 290 through the external terminal 230 by the user. The transmitted sound may be received by the transmission/reception device 291. Meanwhile, the transmission/reception device 291 may output the sound generated from the management device 290 to the outside, as well as receive the sound. The received sound may be transmitted to the signal conversion device 292. In the transmission procedure, the sound may be converted into an acoustic signal and transmitted. The transmitted acoustic signal may be converted into the product information in the signal conversion device 292. The procedure of converting the transmitted acoustic signal may be done in a reverse manner to that described in FIGS. 3 and 4. The converted product information may be transmitted to the management device controller 293. The management device controller 293 may store preset data therein. Therefore, the management device controller 293 may compare the preset data and the converted product information. If it is judged that the converted product information is different from the preset data, the management device controller 293 may transmit the converted product information to the repairman through the repair terminal 295. Further, the management device controller 293 may store the converted product information in the management device storage device 294. Therefore, a fault history or operation information of the laundry treatment machine 210 used by the user may be saved.

Meanwhile, the management device controller 294 may judge whether the converted product information is correctly transmitted or not, as well as compare the converted product information with the preset data. The converted product information may be damaged by external disturbing factors as they are transmitted to the management device controller 294. If the management device controller 294 may judge that the converted product information is damaged, the management device controller 294 may transmit a re-transmit command indicating the damage of the converted product information to the signal conversion device 293. The transmitted re-transmit command may be converted into a management device acoustic signal corresponding thereto in the signal conversion device 293. The converted management device acoustic signal may be transmitted to the transmission/reception device 291. The transmitted management device acoustic signal may be transmitted as a sound corresponding to the management device acoustic signal to the laundry treatment machine 291 through the external terminal 230. The transmitted sound may be transmitted to an acoustic input device 252, such as a microphone, and the re-transmit command may be converted through an inverse conversion device 251 and transmitted to the controller 270. Upon receipt of the re-transmit command, the controller 270 may re-transmit the product information to the conversion device 280. The re-transmitted product information may be output to the outside of the laundry treatment machine 210 again through the sound output device 2S1 in a reverse manner as that described in FIGS. 3 to 7. Therefore, even when damaged product information is transmitted to the management device 290, the laundry treatment machine system W1 may receive the re-transmit command and repetitively transmit correct product information. Further, the laundry treatment machine system W1 may ensure correct repair of the laundry treatment machine 210 by correctly sending the product information.

Embodiments disclosed herein provide a home appliance and a home appliance system that convert product information into an acoustic signal and effectively output a sound corresponding to the acoustic signal to the outside.

Embodiments disclosed herein further provide a home appliance system that may include a home appliance that converts product information into an acoustic signal containing at least one frequency and outputs a signal to the outside, and controls a unit conversion time during which a conversion unit or device outputs the product information as the acoustic signal when the acoustic signal converted in the conversion unit is output to an output unit or device, and a management device that receives the sound output to the outside and inversely converting the sound into the product information based on the sound.

The home appliance and home appliance system according to embodiments disclosed herein allow a user to eliminate a sound output to the outside through a manipulation unit or device. Accordingly, the home appliance may correctly output the sound after eliminating factors disturbing the sound.

Accordingly, the home appliance system may effectively read product information of the home appliance based on the above information. Also, it is possible to acquire correct information of the home appliance by having damaged product information re-transmitted by transmitting an external command signal to the home appliance again.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A home appliance in a home appliance system that transmits product information to a management device via a wire/wireless communication network for fault diagnosis of the home appliance, and diagnoses a fault of the home appliance, comprising:

a selection device that receives input of an external command signal for executing the fault diagnosis from a user;

a conversion device that converts product information into at least one acoustic signal;

a sound output device that outputs a sound corresponding to the at least one acoustic signal output from the conversion device to the outside when the external command signal is input from the selection device; and a controller that includes a storage device that stores the product information of the home appliance for the fault diagnosis, loads the product information stored in the storage device and transmits the the product information to the conversion device when the fault diagnosis is selected through the selection device, and controls a unit conversion time during which the conversion device outputs the product information as the at least one acoustic signal when the at least one acoustic signal is output to the sound output device, wherein the controller provides to the conversion device with first and second unit signals, wherein the first and second unit signals are individual bits of the product information and the first unit signal is binary 0 and the second unit signal is binary 1, and wherein the controller controls the conversion device to output a first acoustic signal corresponding to the first unit signal during a first unit conversion time and a second acoustic signal corresponding to the second unit signal during a second unit conversion time different from the first unit conversion time.

2. The home appliance of claim 1, wherein the product information includes at least one of operation information or fault information of the home appliance.

3. The home appliance of claim 1, wherein the controller controls the conversion device to output a separation signal during a separation time between the first unit conversion time and the second unit conversion time in order to separate the first acoustic signal from the second acoustic signal.

4. The home appliance of claim 1, wherein the first unit signal and the second unit signal have at least one frequency.

5. The home appliance of claim 4, wherein the at least one frequency comprises:

a plurality of frequencies, and wherein the plurality of frequencies comprises: a first frequency corresponding to the first unit signal; and a second frequency different from the first frequency and corresponding to the second unit signal.

6. The home appliance of claim 5, wherein the controller controls:

the first unit conversion time during which the conversion device outputs the first unit signal as the first acoustic signal having the first frequency; and the second unit conversion time, which is different from the first unit conversion time, during which the conversion device outputs the second unit signal as the second acoustic signal having the second frequency.

7. The home appliance of claim 1, further comprising a manipulation device configured to receive input of an operation control command, wherein, when a user inputs the operation control command through the manipulation device, the controller controls the unit conversion time according to the operation control command.

8. The home appliance of claim 1, wherein, when a user inputs the external command signal into the selection device, the controller controls transmission of the product information stored in the storage device to the Conversion device and the conversion device outputs the at least one acoustic signal corresponding to the product information.

9. A home appliance system for fault diagnosis, comprising:

a home appliance in the fault diagnosis, comprising:

a selection device that receives input of an external command signal for executing the fault diagnosis from a user;

a conversion device that converts product information into at least one acoustic signal;

a sound output device that outputs a signal sound corresponding to the at least one acoustic signal output from the conversion device to the outside when the external command signal is input from the selection device; and a controller that includes a storage device that stores the product information of the home appliance for the fault diagnosis, loads the product information stored in the storage device and transmits the the product information to the conversion device when the fault diagnosis is selected through the selection device, and controls a unit conversion time during which the conversion device outputs the product information as the at least one acoustic signal when the at least one acoustic signal is output to the sound output device, wherein the controller provides to the conversion device with first and second unit signals, wherein the first and second unit signals are individual bits of the product information and the first unit signal is binary 0 and the second unit signal is binary 1, and wherein the controller controls the conversion device to output a first acoustic signal corresponding to the first unit signal during a first unit conversion time and a second acoustic signal corresponding to the second unit signal during a second unit conversion time different from the first unit conversion time; and a management device connected to the home appliance via a wire/wireless communication network for the fault diagnosis of the home appliance.

10. The home appliance system of claim 9, wherein the product information includes at least one of operation information or fault information of the home appliance.

11. The home appliance system of claim 9, wherein the controller controls the conversion device to output a separation signal during a separation time between the first unit conversion time and the second unit conversion time in order to separate the first acoustic signal from the second acoustic signal.

12. The home appliance system of claim 9, wherein the first unit signal and the second unit signal have at least one frequency.

13. The home appliance system of claim 12, wherein the at least one frequency comprises a plurality of frequencies, the plurality of frequencies including: a first frequency corresponding to the first unit signal; and a second frequency different from the first frequency and corresponding to the second unit signal.

14. The home appliance system of claim 13, wherein the controller controls:

a first unit conversion time during which the conversion device outputs the first unit signal as the first acoustic signal having the first frequency; and a second unit conversion time, Which is different from the first conversion time, during which the conversion device outputs the second unit signal as the second acoustic signal having the second frequency.

15. The home appliance system of claim 9, wherein the management device comprises:

a transmission/reception device that transmits and receives a sound;

a signal conversion device that inversely converts the sound received from the transmission/reception device into the product information; and a management device controller that reads the converted product information.

16. The home appliance system of claim 15, wherein the management device further comprises a management device storage device that stores the product information read by the management device controller.

17. The home appliance system of claim 15, wherein the management device further comprises a repair terminal that transmits the product information read by the management device controller to a repairman.

18. The home appliance system of claim 9, wherein the sound output from the sound output device is delivered to the management device via a communications network.

19. The home appliance system of claim 18, further comprising an external terminal connected to the management device and the communications network, wherein a user inputs the sound, which is output from the sound output device, into the external terminal.

20. The home appliance system of claim 19, wherein the management device checks the product information by comparing the sound input from the external terminal with previously input data, judges based on the product information, and links the product information to a repairman.

21. The home appliance system of claim 9, further comprising:

an acoustic input device that receives an operation control command from the management device, wherein, when the operation control command is input into the acoustic input device from the management device, the controller controls the unit conversion time according to the operation control command.

* * * * *